United States Patent [19]

Norris

[11] Patent Number: 4,645,107

[45] Date of Patent: Feb. 24, 1987

[54] SHEET MATERIAL DISPENSER

[76] Inventor: Patrick M. Norris, 3817 Shadow Creek Dr., Shreveport, La. 71119

[21] Appl. No.: 753,262

[22] Filed: Jul. 9, 1985

[51] Int. Cl.[4] ..... B65D 85/672

[52] U.S. Cl. ..... 225/37; 225/34; 225/38; 225/42; 225/47; 242/55.3

[58] Field of Search ..... 225/38, 37, 34, 77, 225/32, 47, 42; 242/55.3, 55.2; 312/39–41

[56] References Cited

U.S. PATENT DOCUMENTS

| | | | |
|---|---|---|---|
| 1,895,662 | 1/1933 | Horwitt | 312/40 X |
| 2,819,851 | 1/1958 | Robertson | 225/38 |
| 2,839,255 | 6/1958 | Guyer | 225/77 |
| 2,858,086 | 10/1958 | Saphier | 225/38 |
| 2,943,777 | 7/1960 | Dvoracek | 225/38 |
| 3,409,340 | 11/1968 | Clark | 242/55.3 X |
| 4,094,416 | 6/1978 | Smith | 225/42 X |

FOREIGN PATENT DOCUMENTS

| | | | |
|---|---|---|---|
| 2367012 | 6/1978 | France | 225/47 |
| 520020 | 4/1940 | United Kingdom | 225/77 |

*Primary Examiner*—Frank T. Yost
*Attorney, Agent, or Firm*—John M. Harrison

[57] ABSTRACT

A sheet material dispenser which is characterized by a housing having an open top and bottom, and provided with spaced side rails for engaging a pair of supporting brackets mounted on the bottom of a cabinet. The housing side rails slidably engage the brackets to mount the housing beneath the cabinet and the housing contains multiple cylindrically-shaped rolls of paper towels and wrapping material such as plastic wrap, waxed paper and aluminum foil, in addition to plastic bags contained in a dispensing box. The rolls of wrapping material and paper towels are rotatably secured to oppositely- disposed spindles attached to spindle plates which are slidably inserted in facing flanges attached to opposite sides of the housing walls. The paper towels and various wrapping material are dispensed in sheets from beneath the housing by grasping the leading edges of the rolls, unrolling a sheet of desired length and engaging the material with serrated teeth on cutting blades to produce a sheet of selected size.

10 Claims, 12 Drawing Figures

SHEET MATERIAL DISPENSER

BACKGROUND OF THE INVENTION

1. Field of the Invention

This invention relates to the dispensing of sheet material and boxed flexible bags and more particularly, to a sheet material dispenser which is characterized by a housing having oppositely-disposed side flanges for engaging spaced brackets located on the underside of a cabinet to support the housing in slidably removable relationship. The housing contains multiple rolls of wrapping material as well as paper towels and boxed flexible plastic bags, for selective dispensing from the open bottom of the housing. The rolls of wrapping material and paper towels are rotatably secured inside the housing on spindles attached to spindle plates which are slidably disposed in opposing spindle flanges attached to the opposite sides of the interior of the housing. The top of the housing is open to facilitate replacement of the respective rolls of wrapping material, paper towels, and boxed plastic bags by removing the spindle plates and associated spindles from the spindle flanges. The material is dispensed from the bottom of the housing by grasping the leading edge of the selected rolled material, extending a desired length of the material from the housing and contacting the material with one of several serrated blade edges spanning the housing, to obtain a sheet of material of selected length. The housing is slidably removed from the supporting brackets in order to replenish the supply of rolled wrapping material, paper towels and boxed flexible bags.

2. Description of the Prior Art

The use of wrapping material rolled on cylindrically-shaped cores of cardboard or plastic has long been known in the art. Such materials as paper towels, plastic wrap known as "Saran" wrap and the like, as well as waxed paper, aluminum foil and other products which are useful for wrapping food and covering containers, is widely used in the modern home. Other quick dispensing techniques, including the packaging of flexible plastic bags in boxes such that the removal of an outside bag provides easy access to the next bag and so on, are also much in demand. These plastic bag products are manufactured and sold under such trademarks as "Baggies", "Zip-Lock" bags, and the like and are frequently used to store food products for both refrigeration and freezing purposes. The various paper towels, aluminum foil, plastic wrap, waxed paper and like products are usually rolled on separate tubular cylinders and are rotatably dispensed by open bracket dispensers or directly from the container boxes. Storage of these products usually requires multiple locations which may or may not be conveniently located with respect to each other. The plastic storage bags are typically kept in the pantry or in another easily accessible place where they are periodically removed for use.

Devices for dispensing paper towels and other rolled wrapping material are well known in the art. U.S. Pat. No. 2,550,209, dated Apr. 24, 1951, to E. S. Tuttle, discloses a "Paper Dispenser" which is characterized by a housing having two slots in the front thereof and means therein for rotatably receiving a roll of paper towels and wrapping material such as plastic, aluminum foil or the like, wherein the leading edges of the paper towels and wrapping material project through the slots, respectively, for dispensing desired lengths of the paper towel and wrapping material. Another "Paper Dispenser" is disclosed in U.S. Pat. No. 2,722,387, dated Nov. 1, 1955, also to E. S. Tuttle. This patent details a container which is provided with parallel slots in a front surface thereof and further includes hinged doors which open to receive and locate the paper towel and wrapping material rolls to provide easy access for replenishing the products. U.S. Pat. No. 2,726,825, dated Dec. 13, 1955, to M. S. Ziskin, et al, discloses a "Paper Towel and Wax Paper Dispenser" which includes a shaped housing having a single receiving slot in the front thereof and containing two rolls of wrapping material. The housing is further characterized by an interior which is designed to channel the leading edges of the rolls of material through the common slot for dispensing in selected lengths. A "Sheet Material Dispenser" is detailed in U.S. Pat. No. 3,156,392, dated Nov. 10, 1964, to H. R. Johannes. The Johannes dispenser includes a housing designed to receive three rolls of wrapping material or paper towels, which are separately mounted in rotatable relationship for dispensing through three separate slots located in the front of the housing, by means of rollers provided in cooperation with the respective wrapping material or paper towel rolls, for dispensing purposes. U.S. Pat. No. 3,603,519, dated Sept. 7, 1971, to Jerry A. Brown, et al discloses a dispenser for holding and dispensing material from several rolls of paper or plastic products, the dispenser including a door hinged to the front thereof and provided with slots through which the paper is dispensed. A pair of vertically spaced trays are connected to the sides of the container and are designed to swing between an operative position for supporting a pair of rolls and an outwardly angled position for loading fresh paper rolls thereon. "Inserts For Use With Web Dispensing Means" are disclosed in U.S. Pat. No. 4,372,500, dated Feb. 8, 1983, to Alfred Saraisky. These inserts are designed for insertion in the open ends of cylindrically-shaped cores which receive wrapping material, paper towels and like rolled material, for supporting the cylindrical cores in dispensing mechanisms. The hat-like inserts have a slightly tapered, generally cylindrically-shaped side wall terminating at the narrow diameter end in an integral closed end surface.

It is an object of this invention to provide a new and improved sheet material dispenser which is designed to slidably mount on the underside of a cabinet and to contain multiple rolls of wrapping material and paper towels, as well as a box of flexible plastic bags for easy dispensing of the wrapping material, paper towels and plastic bags in selected lengths and quantities, respectively.

Another object of the invention is to provide a new and improved sheet material dispenser which is characterized by a housing having an open top and bottom, with side flanges for slidable insertion in cooperation with support flanges mounted on the bottom of a cabinet to dispense multiple rolls of wrapping material and paper towels, as well as boxed flexible plastic bags.

Yet another object of this invention is to provide a sheet material dispenser which is designed for dispensing multiple rolls of wrapping material, paper towels and boxed plastic bags from the bottom, while loading replacement rolls and boxes of the plastic bags from the top.

A still further object of the this invention is to provide a new and improved sheet material dispensing device which is characterized by a housing having an open top and bottom and fitted with multiple spindle flanges located in oppose relationship on the housing interior sides. The spindle flanges are designed to slidably receive spindle plates fitted with spindles for supporting multiple rolls of wrapping material and paper towels for dispensing the wrapping material and paper towels from the bottom, and loading the wrapping material and paper towels from the top, of the housing.

Still another object of the invention is to provide a new and improved sheet material dispenser which is characterized by a housing fitted with a pair of spaced side rails for mounting on spaced brackets located on the bottom of a cabinet. The housing is slidably located on the brackets and is open at the top and bottom for dispensing wrapping material, paper towels and plastic bags from the bottom of the housing and replenishing the supply of paper towels, wrapping material, and plastic bags from the top of the housing when the housing is removed from the spaced brackets.

SUMMARY OF THE INVENTION

These and other objects of the invention are provided in a new and improved sheet material dispenser which is slidably mounted beneath a cabinet by means of spaced brackets and cooperating flanges attached to the dispenser housing, with keeper means for securing the housing in functional position and multiple rolls of wrapping material, paper towels, and a box of flexible plastic bags contained within the housing and dispensed from the bottom of the housing and loaded through the open top of the housing when the housing is slidably removed from the brackets and the cabinet.

BRIEF DESCRIPTION OF THE DRAWINGS

The invention will be better understood by reference to the accompanying drawings, wherein.

DESCRIPTION OF THE PREFERRED EMBODIMENTS

Figure 1:
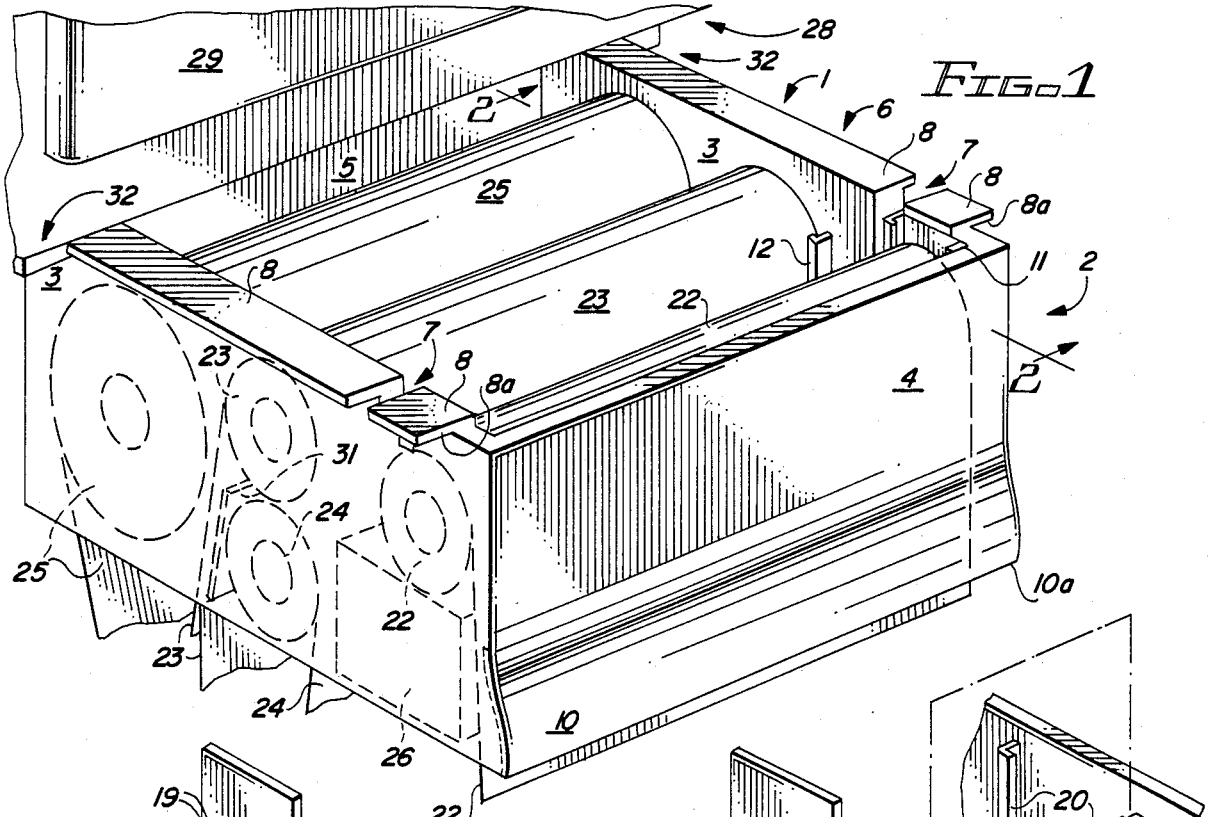
FIG. 1 is a perspective view of a preferred embodiment of the sheet material dispenser of this invention in extended position, slidably mounted on brackets beneath a cabinet.
Figure 4:
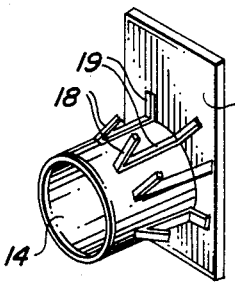
FIG. 4 is a perspective view of an alternative design for the spindles used in the housing.
Figure 2:
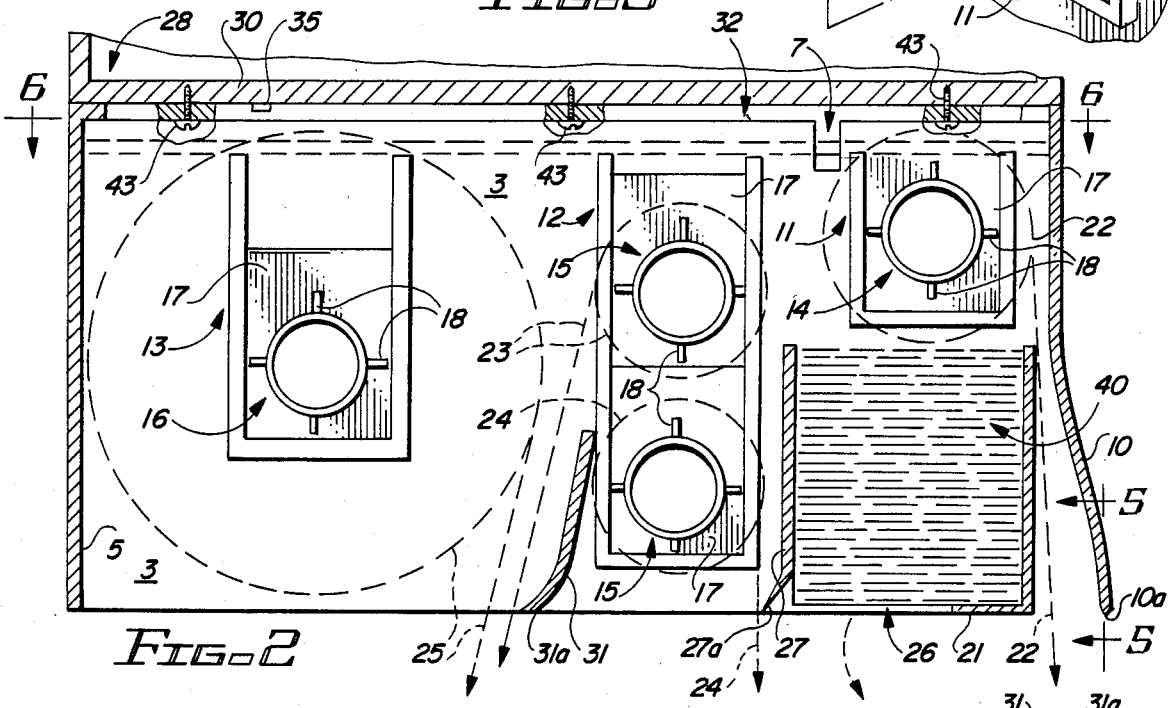
FIG. 2 is a sectional view, taken along line 2—2 of the sheet material dispenser illustrated in FIG. 1.

Referring initially to FIGS. 1 and 2 of the drawings, in a most preferred embodiment the sheet material dispenser of this invention is generally illustrated by reference numeral 1. The sheet material dispenser 1 is characterized by a housing 2 having an open top and bottom, parallel side panels 3, a front panel 4 and a rear panel 5. A pair of side rails 6 are provided in parallel, spaced relationship on the top edges of the side panels 3 to define outwardly-extending side rail flanges 8. The side rails 6 terminate at the forward end of the housing 2 near the front panel 4 at flange edges 8*a*, and a keeper slot 7 is provided in each of the side rail flanges 8, extending downwardly into the side panels 3 at a point rearwardly of the flange edges 8*a*, respectively. In a preferred embodiment of the invention, the front panel 4 curves outwardly at a point approximately midway between the top and bottom of the housing 2, to define an access plate 10 which terminates in a serrated plate edge 10*a*. Rolls of plastic wrap 22, waxed paper 23, aluminum foil 24, and paper towels 25 are located inside the housing 2, along with a box 26 of plastic bags 40, for dispensing downwardly through the conventional slot in the box 26 and the open bottom of the housing 2, as hereinafter further described.

Figure 3:
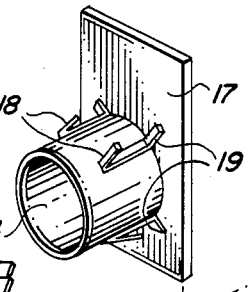
FIG. 3 is an exploded view of a preferred spindle flange, spindle plate and spindle configuration for receiving one end of a roll of paper towel, wrapping material or the like in the sheet material dispenser housing.
Figure 3:
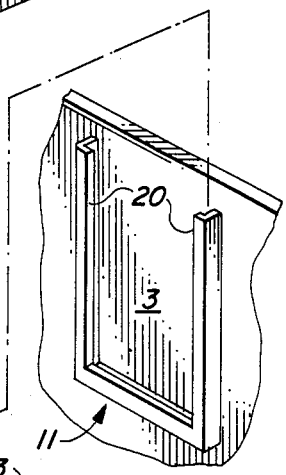
Figure 5:
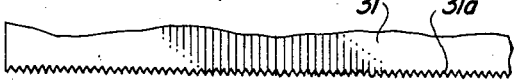
FIG. 5 is a front view, partially in section, of a preferred knife for removing a length of wrapping material, paper towel or the like from a roll of such material located in the housing.
Figure 6:
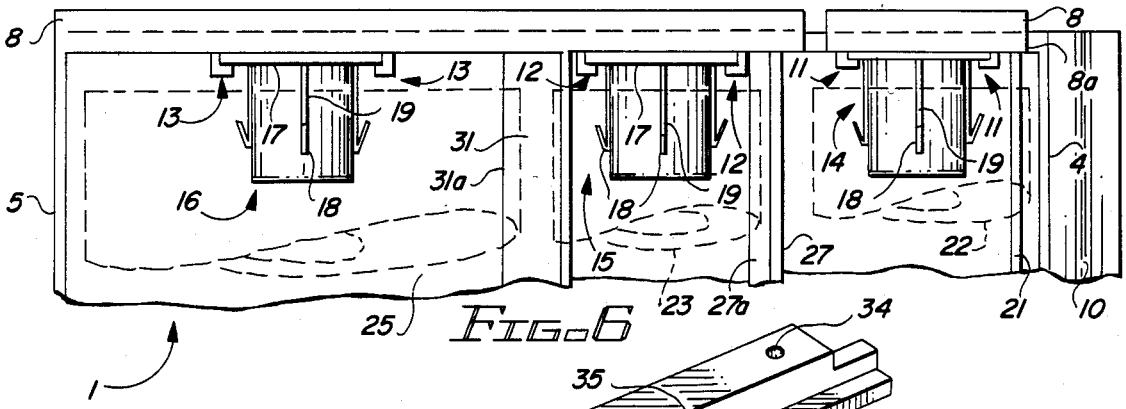
FIG. 6 is a sectional view, taken along line 6—6 in FIG. 2, more particularly illustrating a preferred mounting of the spindles, spindle plates, and flanges inside the housing.
Figure 7:
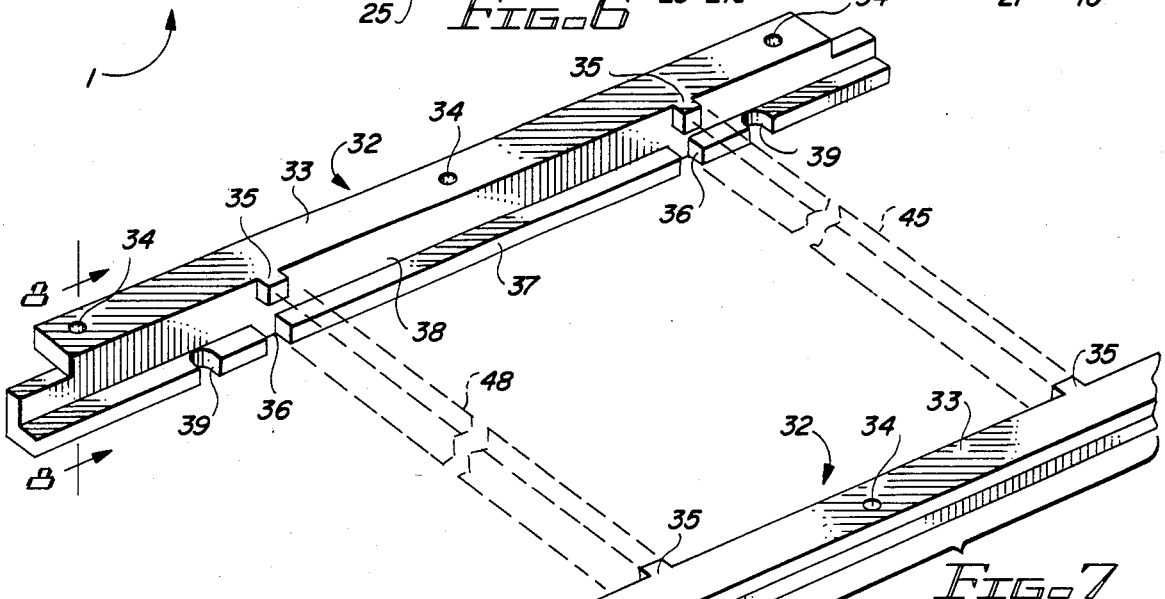
FIG. 7 is a perspective view of a pair of brackets used to support the sheet material dispenser beneath a cabinet.

Referring now to FIGS. 2–6 of the drawings, in another preferred embodiment of the invention a pair of generally U-shaped front spindle flanges 11 are provided in spaced, facing relationship on the inside surfaces of the side panels 3 near the front panel 4 of the housing 2. Similarly, a like pair of center spindle flanges 12 are provided rearwardly of the front spindle flanges 11 on the inside surfaces of the side panels 3, and a pair of rear spindle flanges 13 are secured in facing, spaced relationship to the inside surfaces of the side panels 3 rearwardly of the the center spindle flanges 12 and forwardly of the rear panel 5. The front spindle flanges 11, center spindle flanges 12, and rear spindle flanges 13 are each shaped to define a flange slot 20, as illustrated in FIG. 3, which serves as a receptacle to receive the spindle plates 17, respectively, as illustrated in FIG. 2. In a most preferred embodiment of the invention, the center spindle flanges 12 are deeper than either the front spindle flanges 11 or the rear spindle flanges 13, in order to accomodate a pair of the spindle plates 17 in stacked relationship. A pair of front spindles 14 are secured in perpendicular, facing relationship to the spindle plates 17, respectively, which are located in the front spindle flanges 11, in order to rotatably receive the tubular core (not illustrated) of the roll of plastic wrap 22, illustrated in FIG. 1. Similarly, a center spindle 15 is located on each of the facing, stacked spindle plates 17 located in the center spindle flanges 12 and is sized to receive the tubular cores, or tubes (not illustrated), of the rolls of waxed paper 23 and aluminum foil 24, as illustrated in FIGS. 1 and 2. Likewise, a pair of rear spindles 16 are secured to the opposed spindle plates 17 which are located in the rear spindle flanges 13, to support the cylindrical core located in the center of the roll of paper towels 25. Each of the front spindles 14, center spindles 15 and rear spindles 16 are further provided with spindle finger 18, which project upwardly from the front spindles 14, center spindles 15 and rear spindles 16, respectively, to secure the respective cylindrical cores, or tubes, (not illustrated) carrying the plastic wrap 22, waxed paper 23, aluminum foil 24 and paper towels 25 in rotatable relationship on the front spindles 14, center spindles 15 and rear spindles 16, respectively. Finger slots 19 are also provided in the front spindles 14, center spindles 15 and rear spindles 16, respectively, in order to facilitate molding and forming of the spindle fingers 18 by appropriate techniques well known to those skilled in the art. As illustrated in FIG. 3 of the drawing in a first preferred embodiment of the invention, four such spindle fingers 18 and sets of finger slots 19 are provided in each of the front spindles 14, center spindles 15 and rear spindles 16. In another preferred embodiment of the invention, and referring to FIG. 4, eight such spindle fingers 18 and cooperating finger slots 19 are provided in each of the front spindles 14, center spindles 15 and rear spindles 16, respectively. As further illustrated in FIG. 2 of the drawings, an L-shaped front box bracket 21 and a rear box bracket 27 extend in spaced relationship between the side panels 3, in order to receive and support the box 26, which contains plastic bags 40, for dispensing through the bottom of the housing 2, as indicated by the arrow. In another preferred embodiment of the invention, the bottom end of the rear box bracket 27 is provided with a serrated bracket edge 27*a*, for severing a length of the aluminum foil 24, illustrated in phantom, which is unrolled from the roll 24 of aluminum foil, located on the bottom center spindles 15. Similarly, a length of plastic wrap 22 can be extended from the roll of plastic wrap 22, mounted on the front spindles 14, and cut by contact with the plate edge 10*a* of the access plate 10. In like manner, a length of waxed paper 23 can be severed from the roll of waxed paper 23, located on the top center spindles 15, by extending the waxed paper 23 and pressing the waxed paper 23 against the blade edge 31*a* of the blade 31, which extends between the side panels 3 of the housing 2 rearwardly of the center spindle flanges 12. The blade edge 31*a* of the blade 31 is also used to remove a length of paper towels 25 extended from the roll of paper towels 25, in the event the paper towels 25 are not perforated. A preferred serrated edge configuration for the plate edge 10*a*, bracket edge 27*a* and blade edge 31*a* is illustrated in FIG. 5.

Figure 8:
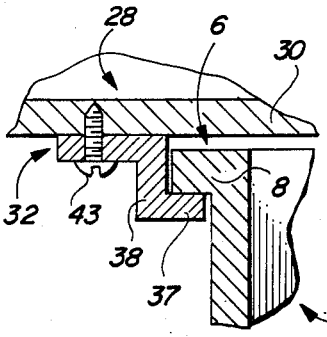
FIG. 8 is a sectional view of one of the brackets, taken along lines 8—8 in FIG. 7, with the bracket engaged by a bracket flange in the housing.

Referring now to FIGS. 1, 2, 7 and 8 of the drawings, in another preferred embodiment of the invention, a pair of brackets 32 are used to support the housing 2 of the sheet material dispenser 1 beneath a cabinet 28, in slidable relationship. The cabinet 28 is illustrated in FIG. 1 and is provided with a cabinet door 29 and a cabinet bottom 30, to which the bracket flanges 33 of the brackets 32 are attached in space relationship by means of screws 43, as illustrated in FIGS. 2 and 8. The screws 43 are designed to register with spaced apertures 34, provided in the bracket flanges 33 of the brackets 32 and extend into the cabinet bottom 30 of the cabinet 28, to fasten the brackets 32 securely to the cabinet 28. Each of the brackets 32 are further characterized by a web 38 extending downwardly from the bracket flange 33 and a support flange 37 extending outwardly from the web 38 in the opposite direction from the bracket flange 33 and in generally parallel relationship with respect to the bracket flange 33. A pair of rounded support flange slots 39 are provided in spaced relationship in the support flanges 37 and a pair of guide slots 36 are also provided in spaced relationship in the support flange 37, at points which are located inwardly of the support flange slots 39. Guides 35 project outwardly from each of the webs 38 in spaced relationship directly above the guide slots 36, respectively, in order to facilitate alignment of the optional spacer bars 45, illustrated in phantom in FIG. 7, under circumstances where the guide bars 45 are used to space the brackets 32.

Figure 9:
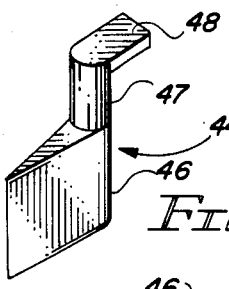
FIG. 9 is a perspective view of a preferred keeper for securing the housing on the brackets in a first preferred embodiment of the invention.
Figure 10:
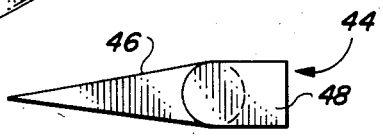
FIG. 10 is a top view of the keeper illustrated in FIG. 9.

When the brackets 32 are secured to the cabinet bottom 30 of the cabinet 28 by means of the screws 43 as illustrated in FIGS. 1, 2 and 8 of the drawings, it will be appreciated that the housing 2 of the sheet material dispenser 1 can be positioned with the side rail flanges 8 resting on the support flanges 37, as illustrated in FIGS. 1 and 8. The housing 2 can then be slidably adjusted inwardly of the cabinet 28, until the front panel 4 of the housing 2 is substantially in the same plane as the front of the cabinet 28. When the housing 2 is so located with respect to the cabinet 28, the support slots 39 located in the support flanges 37 of the brackets 32 are aligned with the keeper slots 7, located in the side rail flanges 8 of the side rails 6. Referring now to FIGS. 9 and 10 of the drawings, a keeper 44 is illustrated and is characterized by a tapered keeper blade 46, having a keeper neck 47 extending therefrom, which keeper neck 47 is terminated by a rounded keeper pin 48. A pair of the keepers 44 are designed to lock the housing 2 in a fully retracted configuration on the brackets 32 by insertion of each keeper pin 48 and keeper neck 47 through a corresponding keeper slot 7 in the side rail flanges 8, until the keeper pins 48 extend above the support flange slot 39 in the brackets 32, respectively. At this point, the keepers 44 are each rotated 90 degrees to engage the keeper pins 48 with the corresponding support flange 37 and lock the housing 2 in retracted position. The keepers 44 are removed from association with the housing 2 and the brackets 32, by first rotating each keeper 44 in a 90 degree arc to align the keeper pin 48 with the corresponding support flange slot 39 and keeper slot 7, and then remove the keeper pins 48 from the support flange slots 39 and keeper slots 7, respectively.

Figure 11:
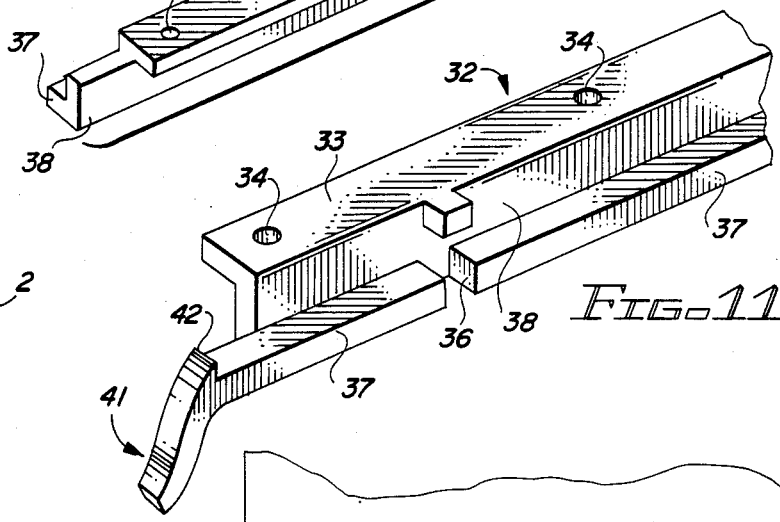
FIG. 11 is a perspective view, partially in section, of an alternative locking embodiment for the brackets illustrated in FIG. 7.
Figure 12:
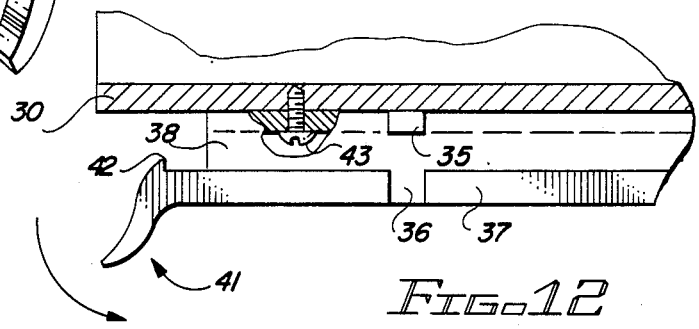
FIG. 12 is a side view, partially in section, of the alternative locking embodiment illustrated in FIG. 11.

Referring now to FIGS. 11 and 12 of the drawings, in another preferred embodiment of the invention a release lever 41 is provided on the front end of the support flanges 37 in each of the brackets 32. The release lever 41 is characterized by a lever shoulder 42, which is designed to engage the flange edge 8*a* of the side rail flanges 8 in the housing 2, when the housing 2 is fully retracted on the brackets 32 beneath the cabinet 28. Release of the housing 2 is achieved by pushing downwardly on the release levers 41 in the direction of the arrow as illustrated in FIG. 12, to disengage the lever shoulders 42 from the flange edges 8*a* and remove the housing 2 from the brackets 32.

It will be appreciated by those skilled in the art that the respective pairs of front spindles 14, center spindles 15 and rear spindles 16 can be provided with rolls of plastic wrap 22, waxed paper 23, aluminum foil 24, paper towels 25 and other wrapping or film material which is wrapped on tubular cores, in any selected order in the housing 2. However, the paper towels 25 are preferably located on the rear spindles 16, since more space is allocated in the rear of the housing 2 to accommodate the normally bulky roll of paper towels 25. Furthermore, the plastic bags 40 may be of any design currently on the market, including plastic bags sold under the trademark "Baggies" and "Zip-lock" bags and other brands and designs known to those skilled in the art. The front box bracket 21 and the rear box bracket 27 can be spaced to accomodate a box 26 of substantially any desired size and the box 26 is located in the front box bracket 21 and the rear box bracket 27 with the conventional dispensing slot (not illustrated) located downwardly, in order to facilitate grasping of the plastic bags 48 through the dispensing slot in conventional fashion, to remove the plastic bags 40 one by one. It will further be appreciated by those skilled in the art that the housing 2 can be of varying size, depending upon the desired size of the rolls of plastic wrap 22, waxed paper 23, aluminum foil 24 and paper towels 25, as well as the size of the box 26.

Referring again to FIGS. 1 and 2 of the drawings, when it is desired to replace the respective rolls of plastic wrap 22, waxed paper 23, aluminum foil 24 and paper towels 25 and the box 26 of plastic bags 40, the housing 2 is removed from association with the cabinet 28, by either removing the two keepers 44 or depressing the release levers 41 located on the front ends of the support flanges 37, as heretofore described, depending upon which design of the release mechanism is utilized in the sheet material dispenser 1. The housing 2 is then removed and the respective rolls of plastic wrap 22, waxed paper 23, aluminum foil 24 or paper towels 25, or the box 26 are removed and replaced by lifting the empty cylindrical tubes which are attached to the respective front spindles 14, center spindles 15, rear spindles 16. This is accomplished by sliding the spindle plates 17 from association with the cooperating front spindle flanges 11, center spindle flanges 12 and rear spindle flanges 13, respectively. The empty cylindrical tubes are then removed from the corresponding set of spindles and a new roll of plastic wrap 22, waxed paper 23, aluminum foil 24 and/or paper towels 25 is inserted on the front spindles 14, center spindles 15 and rear spindles 16, respectively. The corresponding spindle plates 17 are then reinserted in the carrying center spindle flanges 12 and rear spindle flanges 13 and the box 26 of plastic bags 40 is inserted in the front box bracket 21 and rear box bracket 27. The spindle plates 17 which carry the front spindles 14 are then reinserted in the front spindle flanges 11, to position the roll of plastic wrap 22 over the box 26. The leading edges of the plastic wrap 22, waxed paper 23, aluminum foil 24 and paper towels 25 are then extended downwardly in the respective positions illustrated in FIGS. 1 and 2, and the housing 2 is reinserted in the brackets 32 and retracted beneath the cabinet 28.

While the preferred embodiments of the invention have been described above, it will be recognized and understood by those skilled in the art that various modifications may be made therein, and the appended claims are intended to cover all such modifications which may fall within the spirit and scope of the invention.

Having described my invention with the particularity set forth above, what is claimed is:

1. A sheet material dispenser for locating beneath a cabinet and removably supporting and dispensing multiple rolls of rolled sheet material and carrying a box containing plastic bags for dispensing the plastic bags, comprising:

(a) a housing having spaced side panels, a front panel closing one end of said side panels and a rear panel closing the opposite end of said side panels, said housing open at the top and bottom;

(b) a pair of side rails extending outwardly from the top edges of said side panels, respectively, in spaced, substantially parallel relationship for supporting said housing;

(c) a pair of front spindles carried by said side panels in spaced, facing relationship; a first and second pair of center spindles carried by said side panels rearwardly of said front spindles in stacked, spaced, facing relationship, respectively; and a pair of rear spindles carried by said side panels in spaced, facing relationship, said front spindles, said center spindles and said rear spindles engaging opposite ends, respectively, of the rolls of rolled sheet material;

(d) a pair of flanges provided in spaced relationship in said housing for supporting the box containing the plastic bags, and (e) a first blade provided on said front panel, a second blade provided on one of said flanges and a third blade carried by said housing rearwardly of said second blade, for severing a length of sheet material from the rolls of rolled sheet material, respectively.

2. The sheet material dispenser of claim 1 further comprising spindle plates attached to said front spindles, said center spindles and said rear spindles, respectively, and a pair of front spindle flanges secured to said side panels in spaced, facing relationship, with said spindle plates which are attached to said front spindles slidably disposed in said front spindle flanges; a pair of center spindle flanges secured to said side panels in spaced, facing relationship, with said spindle plates which are attached to said center spindles slidably disposed in said center spindle flanges; and a pair of rear spindle flanges secured to said side panels in spaced, facing relationship, with said spindle plates which are attached to said rear spindles slidably disposed in said rear spindle flanges, whereby the rolls of rolled sheet material are selectively removed from said housing by removing said spindle plates and said front spindles, said center spindles and said rear spindles from said front spindle flanges, said center spindle flanges and said rear spindle flanges, respectively.

3. The sheet material dispenser of claim 2 further comprising a pair of brackets secured to the cabinet in spaced, parallel relationship and wherein said side rails slidably engage said brackets, respectively, to removably suspend said housing beneath the cabinet.

4. The sheet material dispenser of claim 3 further comprising flange slots provided in said brackets, keeper slots provided in said side rails and keepers having a keeper blade, a neck extending from said keeper blade and a pin terminating said neck, whereby said housing is locked on said brackets responsive to insertion of said pin and said neck of each of said keepers in said flange slots and said keeper slots and rotation of said keeper blade to position said pin in non-aligned relationship with respect to each of said flange slots and said keeper slots, respectively.

5. The sheet material dispenser of claim 2 wherein the bottom portion of said front panel curves outwardly of the edges of said side panels.

6. The sheet material dispenser of claim 2 further comprising a pair of brackets secured to the cabinet in spaced, parallel relationship and wherein said side rails slidably engage said brackets, respectively, to removably suspend said housing beneath the cabinet, and the bottom portion of said front panel curves outwardly of the front edges of said side panels.

7. A sheet material dispenser for locating beneath a cabinet and removably supporting and dispensing multiple rolls of sheet material and containing a box of plastic bags for dispensing the plastic bags, comprising:

(a) a housing having spaced side panels, a front panel closing one end of said side panels and a rear panel closing the opposite end of said side panels, said housing open at the top and bottom;

(b) a pair of side rails extending outwardly from the top edges of said side panels, respectively, in spaced, substantially parallel relationship for supporting said housing;

(c) a pair of front spindles carried by said side panels in spaced, facing relationship; a first and second pair of center spindles carried by said side panels rearwardly of said front spindles in stacked, spaced, facing relationship, respectively; and a pair of rear spindles carried by said side panels in spaced, facing relationship, said front spindles, said center spindles and said rear spindles engaging opposite ends, respectively, of the rolls of rolled sheet material;

(d) generally flat spindle plates attached to said front spindles, said center spindles and said rear spindles, respectively, and a pair of front spindle flanges secured to said side panels in spaced, facing relationship, with said spindle plates which are attached to said front spindles slidably disposed in said front spindle flanges; a pair of center spindle flanges secured to said side panels in spaced, facing relationship, with said spindle plates which are attached to said center spindles slidably disposed in said center spindle flanges; and a pair of rear spindle flanges secured to said side panels in spaced, facing relationship, with said spindle plates which are attached to said rear spindles slidably disposed in said rear spindle flanges, whereby the rolls of rolled sheet material are selectively removed from said housing by removing said spindle plates and said front spindles, said center spindles and said rear spindles from said front spindle flanges, said center spindle flanges and said rear spindle flanges, respectively, (e) a pair of flanges provided in spaced relationship in said housing for supporting the box containing the plastic bags; and (f) a first blade provided on said front panel, a second blade provided on one of said flanges and a third blade carried by said housing rearwardly of said second blade, for severing a length of sheet material from the rolls of rolled sheet material, respectively.

8. The sheet material dispenser of claim 7 wherein the bottom portion of said front panel curves outwardly of the edges of said side panels.

9. The sheet material dispenser of claim 7 further comprising a pair of brackets secured to the cabinet in spaced, parallel relationship, a release lever provided at the end of each said brackets and a lever shoulder provided in said release lever, respectively, and wherein said side rails slidably engage said brackets and said lever shoulder, respectively, to removably suspend said housing beneath the cabinet.

10. The sheet material dispenser of claim 7 wherein the bottom portion of said front panel curves outwardly of the edges of said side panels and further comprising a pair of brackets secured to the cabinet in spaced, parallel relationship, a release lever provided at the end of each said brackets and a lever shoulder provided in said release lever, respectively, and wherein said side rails slidably engage said brackets, respectively, to removably suspend said housing beneath the cabinet.

* * * * *